US007488203B2

(12) United States Patent
Leddusire

(10) Patent No.: US 7,488,203 B2
(45) Date of Patent: Feb. 10, 2009

(54) ELECTRICAL OUTLET ASSEMBLY

(75) Inventor: Ron Leddusire, Seattle, WA (US)

(73) Assignee: Dolan Northwest, LLC, Portland, OR (US)

( * ) Notice: Subject to any disclaimer, the term of this patent is extended or adjusted under 35 U.S.C. 154(b) by 0 days.

(21) Appl. No.: 11/683,542

(22) Filed: Mar. 8, 2007

(65) Prior Publication Data

US 2008/0220646 A1 Sep. 11, 2008

(51) Int. Cl.
*H01R 13/60* (2006.01)
*H01R 13/66* (2006.01)

(52) U.S. Cl. ..... 439/535

(58) Field of Classification Search ..... 439/535, 439/214

See application file for complete search history.

(56) References Cited

U.S. PATENT DOCUMENTS 5,135,411 A * 8/1992 Wiley et al. ..... 439/535
5,917,694 A * 6/1999 Denny ..... 361/643
6,243,257 B1 * 6/2001 Ester ..... 361/625
7,173,184 B2 * 2/2007 Hull et al. ..... 174/58

OTHER PUBLICATIONS

"Monster MP OTG400 BK Outlets to Go Power Strip, 4 AC Outlets (Black)," Monster Cable Products, Inc., Brisbane, CA, date unknown, product available through the internet.
"Assemble" Power/Data Distribution Unit, Byrne Electrical Specialists, Inc., Rockford, Michigan, date unknown, product available through the internet.
Altinex "PNP350 Pop 'N Plug Slim" Tabletop Interconnect Box, Altinex, Brea, California, date unknown, product available through the internet.
Smartsockets Tabletop Surge Protector, Tibo Software, Inc., Palo Alto, California, date unknown, product available through the internet.
Smartsockets Portable Surge Protector, Tibo Software, Inc., Palo Alto, California, date unknown, product available through the internet.
Clamp-On Surge Protector, Belkin International, Inc., Compton, California, date unknown, product available through the internet.
"The Brain" Data/Power-Hub, grommet surge protector, Hardware Concepts, Inc., Opa Locka, Florida, date unknown, product available through www.hardwareconcepts.com.
Interact JR Pop-Up Power surge protector, date unknown, product available through www.rockler.com.
Westinghouse, Corner Power Block, date unknown, product available through the internet.

* cited by examiner

*Primary Examiner*—Javaid Nasri
(74) *Attorney, Agent, or Firm*—Marger Johnson & McCollom, P.C.

(57) ABSTRACT

An electrical outlet device includes an enclosure that contains one or more electrical outlets. The enclosure has a top surface, a bottom surface, and a side surface extending from the top surface to the bottom surface and forming an enclosure perimeter. The device further includes a cavity extending into the side surface of the enclosure and configured for receiving an electrical power cord that attaches inside of the enclosure perimeter. A top end of the power cord attaches to the enclosure inside the cavity and drops vertically downward from the enclosure. A top surface, front end, and sides of the enclosure extend around a front and sides of the top end of the power cord. The unique shape also allows a wider variety of power transformer shapes to be plugged into the enclosure at the same time.

19 Claims, 11 Drawing Sheets

ELECTRICAL OUTLET ASSEMBLY

BACKGROUND

People use all sorts of computer, television, and telecommunication equipment in addition to other home and office lighting and electrical devices. People are also carrying around more portable electrical devices such as cellular telephones, Personal Digital Assistants (PDAs), laptop computers, personal music and/or video players, wireless Universal Serial Bus (USB) devices, etc. This electrical equipment either needs to be constantly plugged into a power supply or intermittently plugged into a power supply to recharge an internal battery.

Problems exist providing electrical outlets for powering all of these different electrical devices. Often the power cords for portable devices include a power transformer that is enclosed along with the electrical plug. These transformers take up a large amount of space and often prevent other power cords from being plugged into adjacent electrical outlets.

Another problem relates to the extension cords that provide additional electrical plug-ins. Often the extension cords sit loosely on the floor or on a table. It is difficult to plug devices into these freely sitting extension cords. Existing extension cords can also take up a substantial amount of space on or underneath a table or desk, and generally detract from the aesthetics of a room. In other words, it is generally undesirable to see tangled extension cords extending over or underneath furniture.

The present invention addresses this and other problems associated with the prior art.

SUMMARY OF THE INVENTION

An electrical outlet device includes an enclosure that contains one or more electrical outlets. The enclosure has a top surface, a bottom surface, and a side surface extending from the top surface to the bottom surface and forming an enclosure perimeter. The device further includes a cavity extending into the side surface of the enclosure and configured for receiving an electrical power cord that attaches inside of the enclosure perimeter.

A surface mounted outlet assembly includes an enclosure that contains one or more power plug-ins. The assembly further includes a mounting bracket that rigidly mounts the enclosure to furniture or to a wall. A shape of the enclosure in combination with a shape and arrangement of the mounting bracket allow a top end of a power cord to attach and drop vertically downward from the enclosure. A top surface, front end, and sides of the enclosure extend around a front and sides of the top end of the power cord. A vertically dropped portion of the power cord is less visible. The unique shape also allows a wider variety of power transformer shapes to be plugged into the enclosure at the same time. The overall shape and arrangement of the electrical outlet assembly is also more aesthetically appealing than existing extension cords.

The foregoing and other objects, features and advantages of the invention will become more readily apparent from the following detailed description of a preferred embodiment of the invention which proceeds with reference to the accompanying drawings.

DETAILED DESCRIPTION

Enclosure

Figure 1:
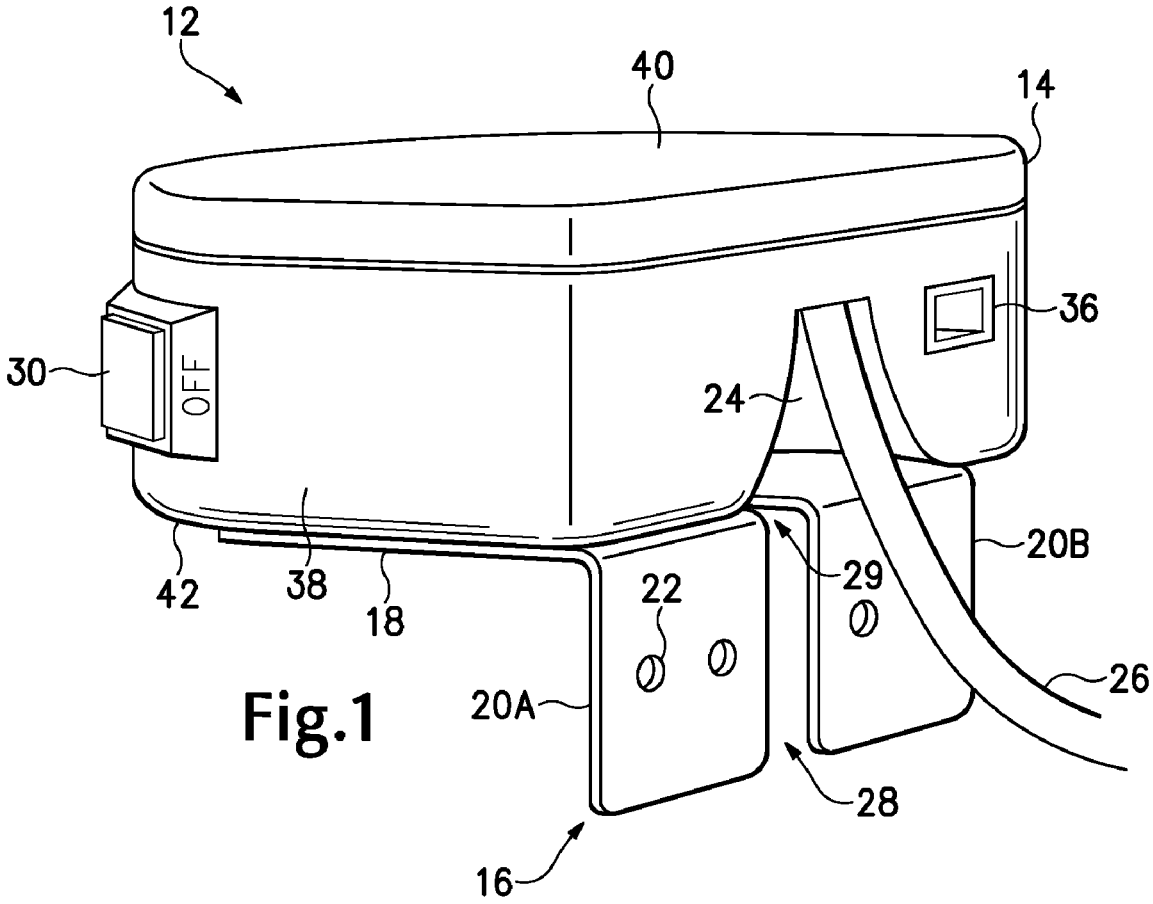
FIG. 1 is a perspective view of an electrical outlet assembly according to one embodiment.
Figure 2A:
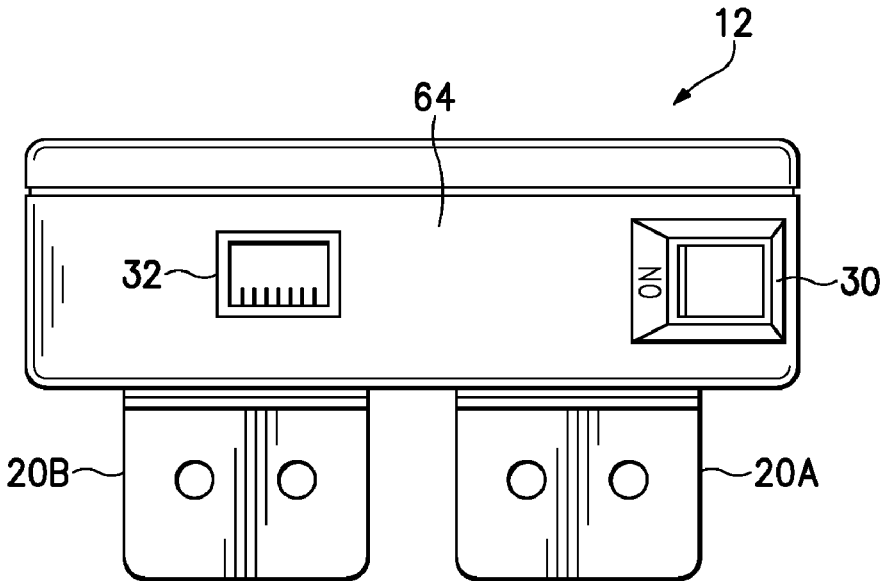
FIG. 2A is a front view of the electrical outlet assembly shown in FIG. 1.
Figure 2B:
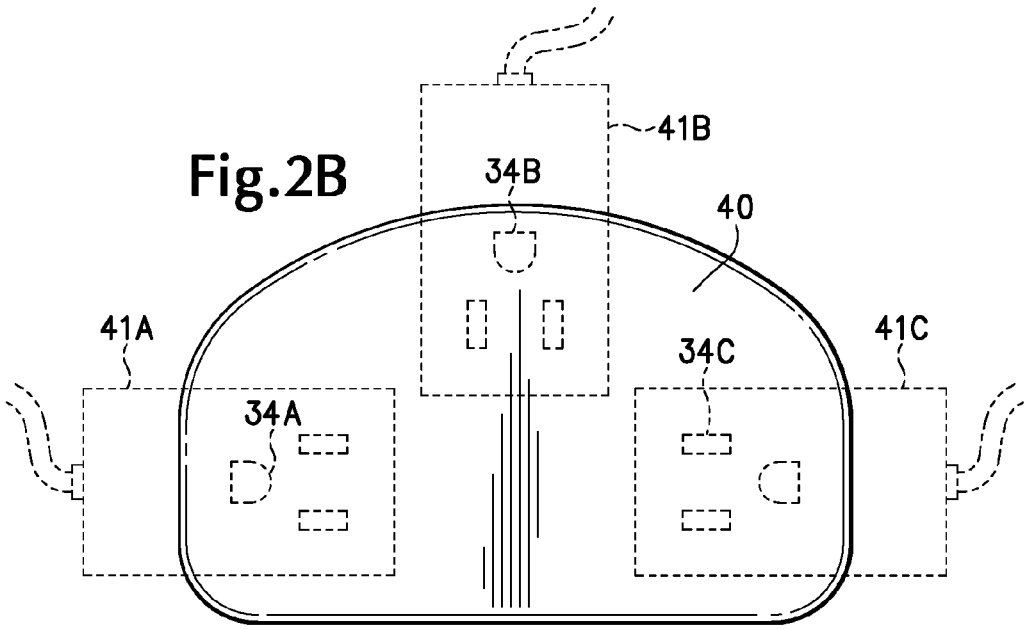
FIG. 2B is the same front view as FIG. 2A but shown with attached electrical plugs.
Figure 3:
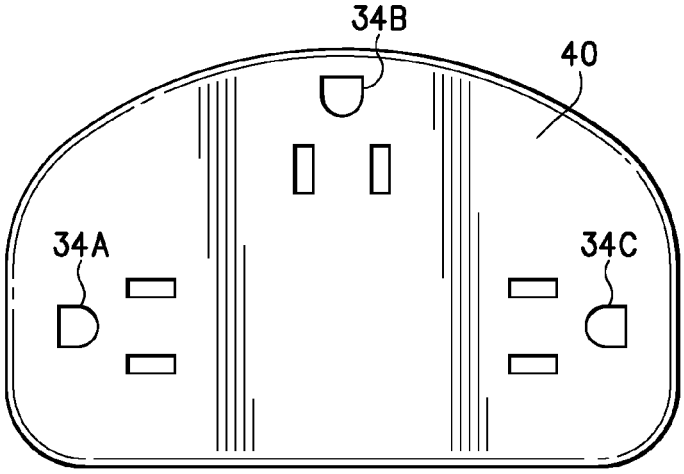
FIG. 3 is a top view of the electrical outlet assembly shown in FIG. 1.
Figure 4:
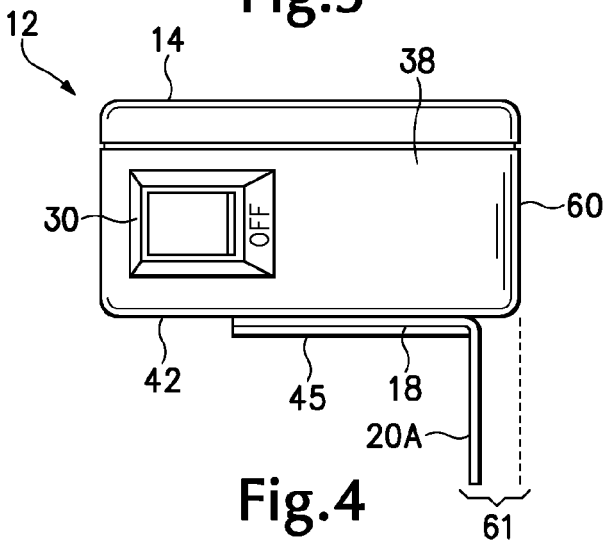
FIG. 4 is a side view of the electrical outlet assembly shown in FIG. 1.
Figure 5:
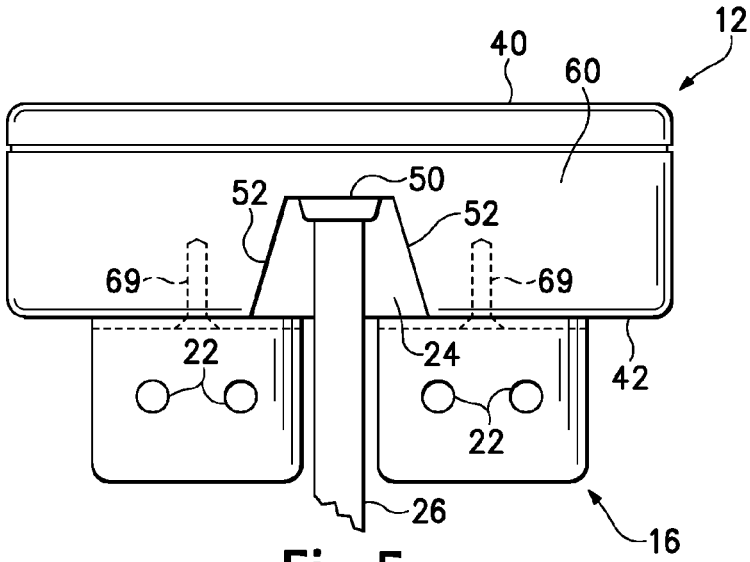
FIG. 5 is a rear view of the electrical outlet assembly shown in FIG. 1.
Figure 6:
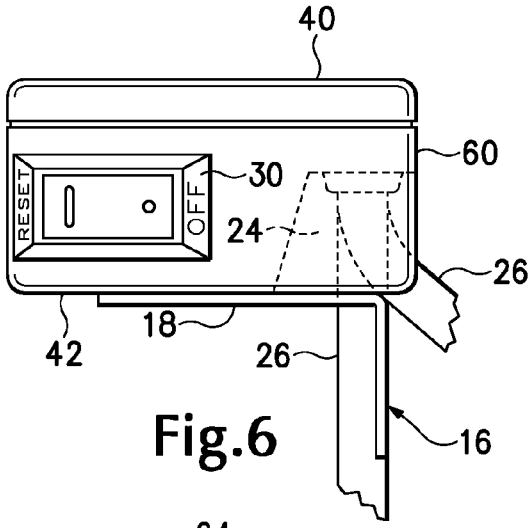
FIG. 6 is a side view of the electrical outlet assembly shown in FIG. 1 showing see through lines for a rear cavity.
Figure 7A:
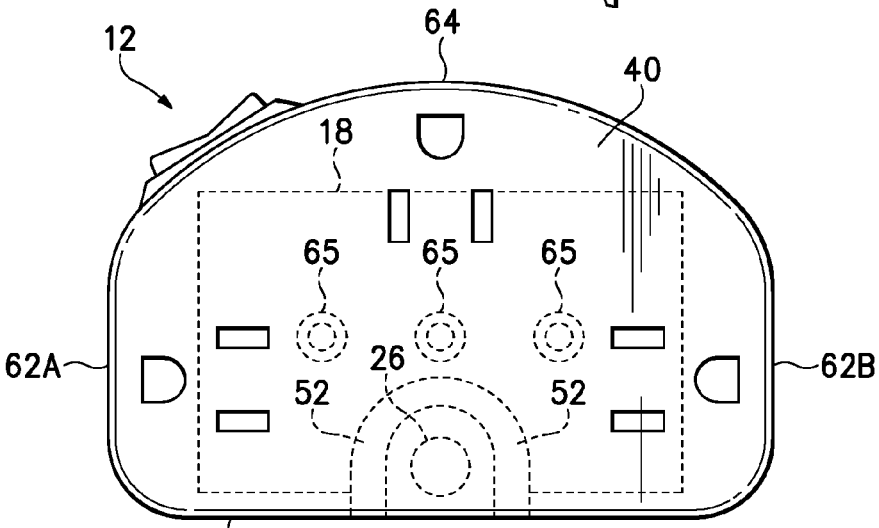
FIG. 7A is a top view of the electrical outlet assembly shown in FIG. 1 showing see through lines for the rear cavity and a mounting plate.

FIG. 1 is a perspective view of a molded electrical outlet assembly 12, FIG. 2A is a front view, FIG. 2B is the same front view but shown with attached power plugs, FIG. 3 is a top view, FIG. 4 is a side view, FIG. 5 is a rear view, FIG. 6 is a side view showing see through lines for a rear cavity, and FIG. 7A is a top view showing see through lines for the rear cavity and a mounting plate. The side views are substantially mirror images with the exception of an optional power switch 30.

Referring to FIGS. 1-7A, the molded electrical outlet assembly 12 includes an enclosure 14 containing one or more electrical outlets 34. The enclosure 14 has a top surface 40, a bottom surface 42, and a side surface 38 extending from the top surface 40 to the bottom surface 42.

FIG. 5 shows the enclosure 14 having a substantially flat horizontal top surface 40 and a flat horizontal bottom surface 42. The side surface 38 extends vertically down from the top surface 40 to the bottom surface 42. FIG. 7A shows an oval front face 64 that extends to parallel side walls 62A and 62B that extend to a straight perpendicular back end 60. FIG. 3 shows the enclosure including three electrical outlets (sockets) 34A, 34B, and 34C. Each outlet 34 extends radially around the outside perimeter of enclosure 14 and is aligned toward a center location.

A first electrical outlet 34A is located on a first side of the enclosure 14, a second electrical outlet 34B is located at a front end of the enclosure 14 and aligned at a 90 degree angle with the first electrical outlet 34A. A third electrical outlet 34C is located on a second opposite side of the enclosure 14 and aligned at a 90 degree angle with the second electrical outlet 34B and aligned at a 180 degree angle with the first outlet 34A.

The unique combination of the rounded front end 64 and radially positioned electrical outlets 34A-34C allow a larger variety of transformer power cords to be plugged into enclosure 14. For example, FIG. 2B shows a first transformer/power 41A plug may be inserted into outlet 34A. If the enclosure for the transformer/power plug is relatively wide, it still would not cover either outlet 34B or outlet 34C. Similar wide or long transformer/power plugs 41B and 41C could also be inserted into outlets 34B and outlet 34C respectively, without covering up the other adjacent outlets or obstructing other transformer power cords.

In one example, the enclosure is approximately 4 inches long, 2.5 inches wide, and 1.25 inches high. Of course other sizes could alternatively be used depending on the number of desired electrical outlets 34. The enclosure 40 may typically be made from a plastic or resin material but could alternatively be made from any other solid material such as a non-conductive metal or ceramic material. In one embodiment, the plastic enclosure 14 can be formed with a stylized finish that simulates different decorative textures such as a wood, ceramic or metal. Any variety of different colors can also be used.

In one embodiment, a switch 30, and/or switch with current protector, is located on the front end 64. The switch 30, and/or switch with current protector, is used for connecting or disconnecting power from a power cord 26 to the three outlets 34A-34C. In another embodiment, there is no switch 30, and/or switch with current protector, and power from power cord 26 is constantly provided to outlets 34.

In another embodiment, the enclosure may also contain a power surge suppression unit that works in combination with the switch 30 to prevent power surges from disrupting or damaging the devices connected to outlets 34.

In an alternative embodiment, a RJ45 data port socket 36 is located on the back end 60 of enclosure 40. The data port socket 36 is electrically coupled to a second data port socket 32 located on the front end 64 of enclosure 14. The RJ45 data port socket 36 connects to a data port in a wall or cable, such as used with Ethernet connections. The socket 32 then serves as a high speed data port extension for plugging to a computing device. The sockets 32 and 36 are optional and may not be used on some outlet assemblies 12.

Power Cord Cavity

Referring to FIGS. 1, and 5-7A, a cavity 24 extends into the back end 60 of the enclosure 14 and is configured for receiving the power cord 26. The cavity 24 includes a top face 50 that extends below the top surface 40 of the enclosure 14 and a side face 52 that extends conically outward from the top face 50 down through the bottom surface 42 of the enclosure 14.

The power cord 26 is connected up into the top face 50 of the cavity 24, drops down between side face 52, and through the opening in the bottom surface 42 of the enclosure 14. In one embodiment, the top face 50 of cavity 24 is substantially parallel with the top surface 40 of the enclosure 14. The side face 52 slopes outward in an inverted partial cone shape away from the top face 50 and towards the bottom surface 42 of the enclosure 14.

The cavity 24 allows the power cord 26 to drop vertically and substantially straight down from a location within the perimeter of enclosure 14 and underneath the top surface 40. The top part of power cord 24 is effectively hidden from sight when viewing the enclosure 14 from the top, front, and sides. The vertical downward position of the power cord 26 also allows the back end 60 of enclosure 14 to be abutted against a wall without requiring additional space for the power cord 26. When abutted up against a wall, the enclosure 14 in combination with the wall enclose the entire top end of the power cord 26 further increasing the aesthetic appeal of the outlet assembly 12. These features will be shown and described in more detail below.

Mounting Bracket

A mounting bracket 16 includes a support base 18 mounted to the bottom surface 42 of the enclosure 14 and mounting arms 20 extending downward from the support base 18 at an approximately 90 degree angle. The mounting arms 20 includes a first arm 20A aligned on a first side of the cavity 24 and a second arm 20B aligned on a second opposite side of the cavity 24. A space or channel 28 in bracket 16 allows the power cord 26 to extend down through the cavity 24 and down between the first arm 20A and the second arm 20B. The mounting bracket 16 could be made of any rigid material such as steel, hard plastic, or ceramic.

In one embodiment as shown in FIG. 4, the mounting arms 20 are offset back a distance 61 in front of the back end 60 of enclosure 14. This offset 61 provides further room for the power cord 26 to drop down from cavity 24. In an alternative embodiment, the mounting arms 20 may extend down from the support base 18 substantially flush with the back end 60 of the enclosure 14. In other words, in this embodiment, the distance 61 is substantially zero. In this alternative embodiment, the top end 29 of slot 28 (FIG. 1) may extend further back into the support base 18 so that the power code 26 can still drop straight down from inside of cavity 24 through the mounting bracket 16.

As shown in FIG. 7A, the support base 18 can include holes 65 that receive screws 69 (FIG. 5) that attach the mounting bracket 16 to the bottom surface 42 of the enclosure 14. In an alternative embodiment, the support base 18 could be glued to the bottom surface 42. Holes 22 in the mounting arms 20 receive screws that extend into a structure, such as a piece of furniture or into a wall. These screws rigidly hold the electrical outlet assembly 12 to the mounted structure.

In one embodiment as shown in FIG. 4, a rubber pad 45 is attached to the bottom side of support base 18. The rubber pad 45 prevents the bottom side of the support base 18 from scratching a top surface of a table or other mounted furniture. The rubber pad 45 can also prevent water or other spills from seeping into the enclosure 14. In one embodiment, the mounting plate 16 is further mounted to the side of a piece of furniture so that the support base 18 is suspended above the mounted furniture. This provides more separation between enclosure 14 and the surface of the mounted furniture further preventing the support base 18 from scratching the furniture and preventing fluids spilled on the furniture from coming in contact with enclosure 14.

In yet another embodiment, the bottom surface 42 of the enclosure 14 may include a recess that receives the support base 18. The recess has substantially the same shape as the support base 18 as shown in FIG. 7A and is approximately as deep as the thickness of support base 18. Thus, the support base 18 and the bottom surface 42 of enclosure 14 are substantially flush. This allows the bottom surface 42 of the enclosure 14 to sit directly on a top surface of the mounted furniture. This would further improve the aesthetics of the electrical outlet assembly 12 by hiding substantially the entire support base 18 within the recess in bottom surface 42. In this embodiment, the rubber pad 45 may extend over both the bottom side of support base 18 and the bottom surface 42 of enclosure 14.

In one embodiment, the mounting bracket 16 may be made of one or more pieces of metal or other relatively rigid material such as a ceramic or hard plastic material. In one embodiment, the mounting bracket 16 may be a separate piece of material from the enclosure 40 and accordingly attached to enclosure 40 using screws 69 (FIG. 5) or some alternative adhesive material. In yet another attachment embodiment, the enclosure 40 may be made from a metal material and the mounting bracket 16 welded to the enclosure 40.

In an alternative embodiment, the enclosure 40 and mounting bracket 16 are formed from a same unitary piece of molded material. For example, the enclosure 40 and mounting bracket 16 may be formed of the same piece of plastic using a mold. In this embodiment, the support base 18 may not even exist and instead the mounting arms 20A and 20B may be formed and extend directly down from the bottom surface 42 of enclosure 40. In this embodiment and in some mounting configurations, the bottom surface 42 may sit down directly against the mounted furniture.

In one embodiment, the enclosure and possibly mounting arms 20 are formed of a polymeric material and are therefore, lightweight and inexpensive. The enclosure 40, and possibly also the mounting arms 20, can also by a unitary piece of molded metal, such as zinc, or some other material. One embodiment of the enclosure 40 uses a molded Polyman 509 material which is a trade name for a flame retardant mix of ABS and PVC by A.L. Schulman Company.

Figure 7B:
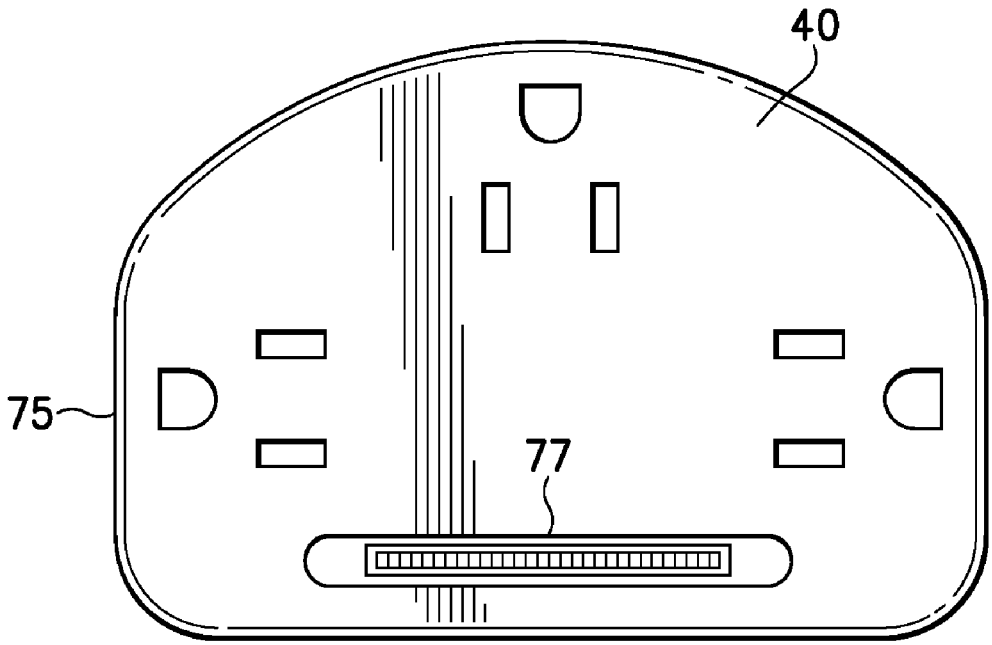
FIG. 7B is an alternative embodiment of the electrical outlet assembly shown in FIG. 1 that includes a media player charger port.

FIG. 7B shows an alternative enclosure power outlet assembly 75 where the enclosure 40 includes a power attachment 77 for a media player, such as an IPOD® or MP3 player. The switch 30 shown in FIG. 2 may control the connection of power to attachment 77 or power could be constantly provided by power cord 26 to power attachment 77. In another embodiment, the second switch 30 may selectively provide power to attachment 77. A transformer (not shown) may reside within enclosure 40 to convert AC power from power cord 26 to a DC power for recharging a battery inside of the media player.

Figure 7C:
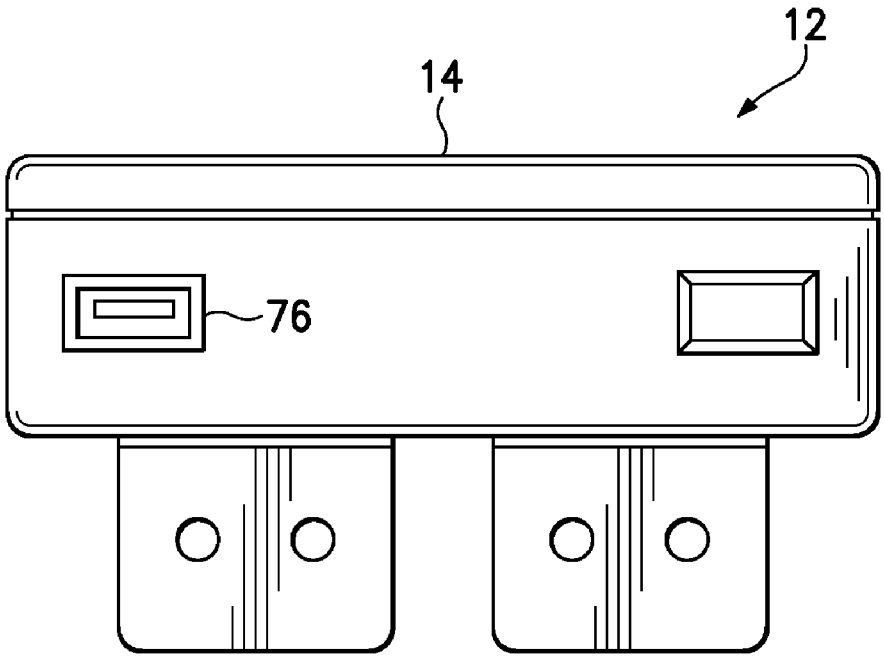
FIG. 7C is an alternative view of the electrical outlet assembly that includes a USB plug.
Figure 8A:
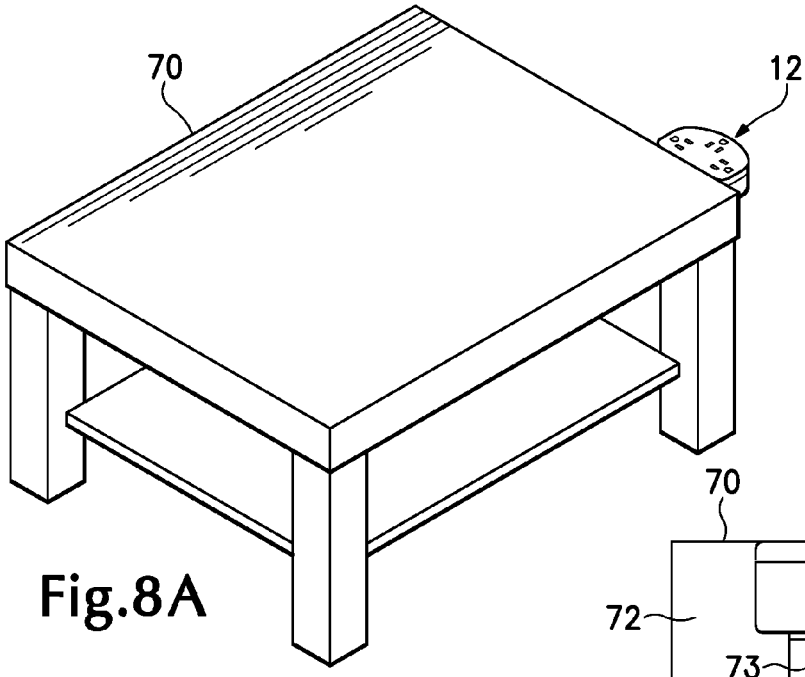
FIGS. 8A-8D show one mounting configuration for the electrical outlet assembly in FIG. 1.
Figure 8B:
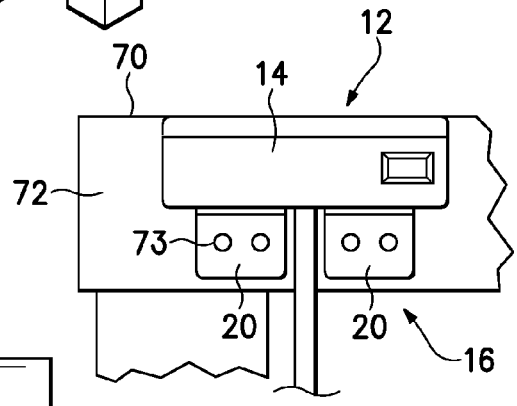
Figure 8C:
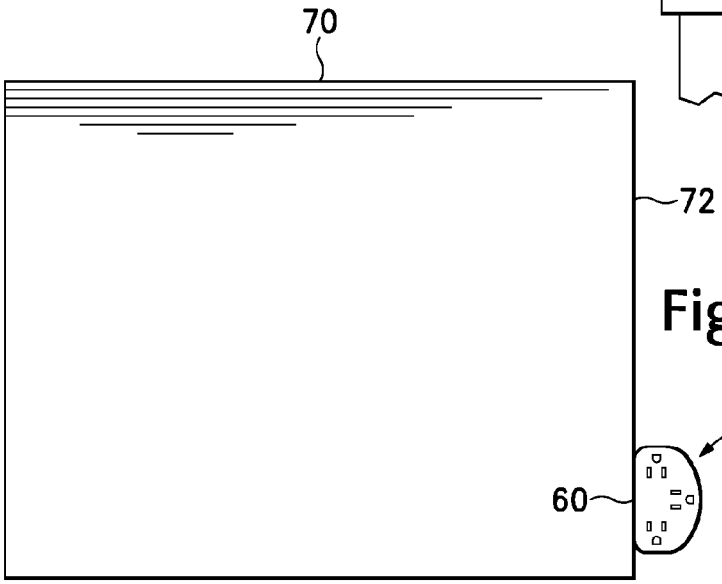
Figure 8D:
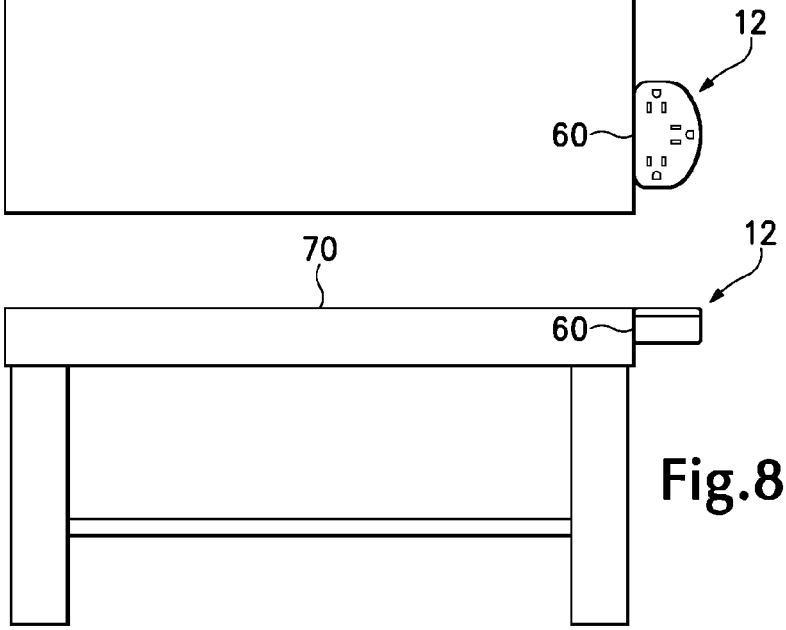

FIG. 7C shows yet another embodiment of the electrical outlet assembly 12 that includes a universal serial bus (USB) plug 76. In this embodiment a transformer within enclosure 14 converts power from power cord 20 (FIG. 1) into USB rated power that is supplied to USB plug 76. Accordingly, any USB device can be powered by connecting to plug 76.

Furniture Attachment

The unique combination and arrangement of the enclosure 14 and mounting bracket 16 allow the electrical outlet assembly 12 to be both securely attached to furniture or to a wall in an aesthetically pleasing manner while at the same time allowing the furniture to abut up against a wall or other furniture. The shape of the enclosure 14 in combination with a shape and arrangement of the mounting bracket 16 also allow the power cord 26 to attach and drop vertically down out over an edge of the mounted furniture while the enclosure covers the top end of the power cord.

The electrical outlet assembly 12 is particularly useful in hotels and motels where room occupants frequently bring electrical devices that constantly need to be plugged into electrical outlets. The mounting bracket 16 can be mounted on almost any piece of furniture and increases the ease in which electrical plugs can be inserted and removed from outlets 34. The mounting bracket 16 when mounted to a wall or furniture also prevents the outlet assembly 12 from being stolen.

To explain in more detail, FIGS. 8A-8D show how the electrical outlet assembly 12 is mounted to a table 70. In this embodiment, the arms 20 of mounting bracket 16 may extend down in a same plane with the back end 60 of enclosure 14. The mounting bracket 16 is attached with screws 73 to the side 72 of table 70. As can be clearly seen in FIG. 8C, the back end 60 of the enclosure 14 then abuts up against the edge 72 of table 70 in a substantially flush manner. At the same time, the top of power cord 26 is substantially hidden from the top view shown in FIG. 8C, the perspective view shown in FIG. 8A, and the back view shown in FIG. 8B.

Figure 9A:
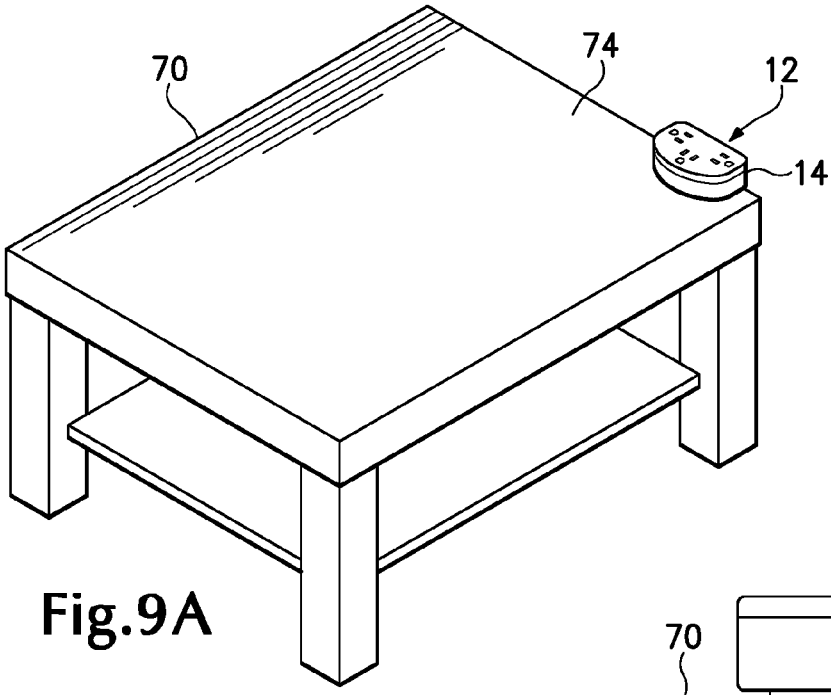
FIGS. 9A-9C show another mounting configuration for the electrical outlet assembly in FIG.1.
Figure 9B:
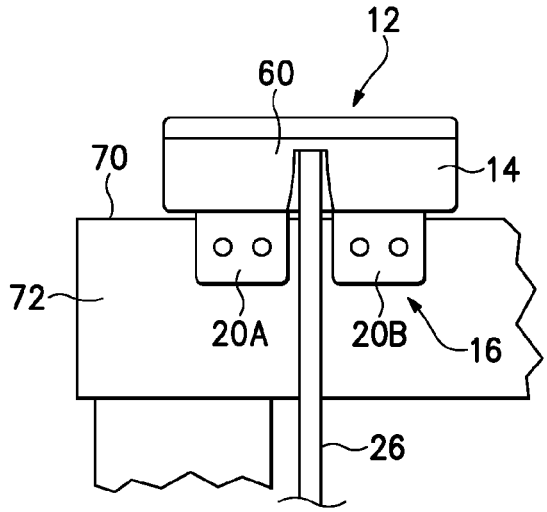
Figure 9C:
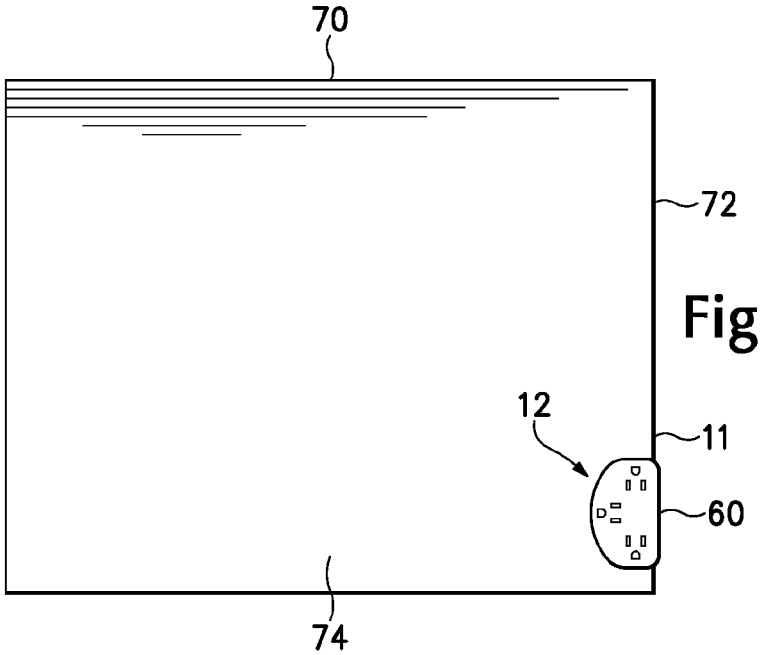

FIGS. 9A-9C show an alternative installation of the electrical outlet assembly 12 where the mounting bracket 16 has a slight offset 61 (FIG. 4) back from the back end 60 of enclosure 14. As seen in the FIG. 9A, the arms 20A and 20B of mounting bracket 16 are attached to the side 72 of table 70. However in this configuration, the mounting bracket 16 is aligned in the opposite direction holding or suspending the enclosure 14 above a top surface 74 of table 70.

This arrangement may be more suitable when the edge 72 of desk 70 needs to be moved up against a wall. The power cord 26 is still allowed to drop straight down from cavity 24. The enclosure 60 can then be moved up against a wall without the power cord 26 coming between the back end 60 of enclosure 60 and the wall. Thus, the enclosure 14 hides the top of power cord 16 when viewed from the top or side angles while the wall hides the power cord from view from a rear angle.

Figure 10:
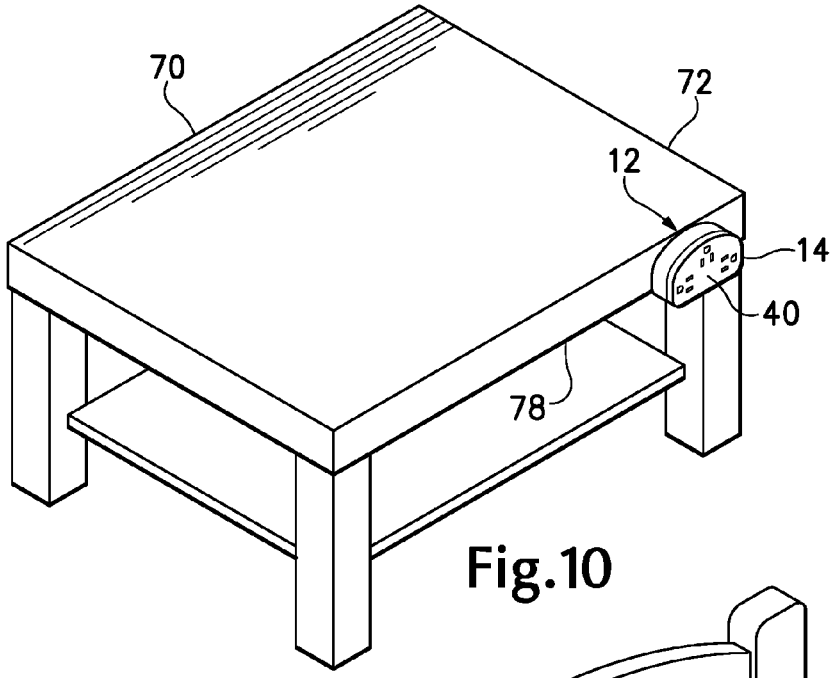
FIG. 10 shows another mounting configuration for the electrical outlet assembly in FIG. 1.

FIG. 10 shows a configuration where the mounting bracket is attached to a bottom side 78 of table 70. In this arrangement, the top surface 40 of enclosure 14 is substantially parallel with the side 72 of table 70.

Figure 11A:
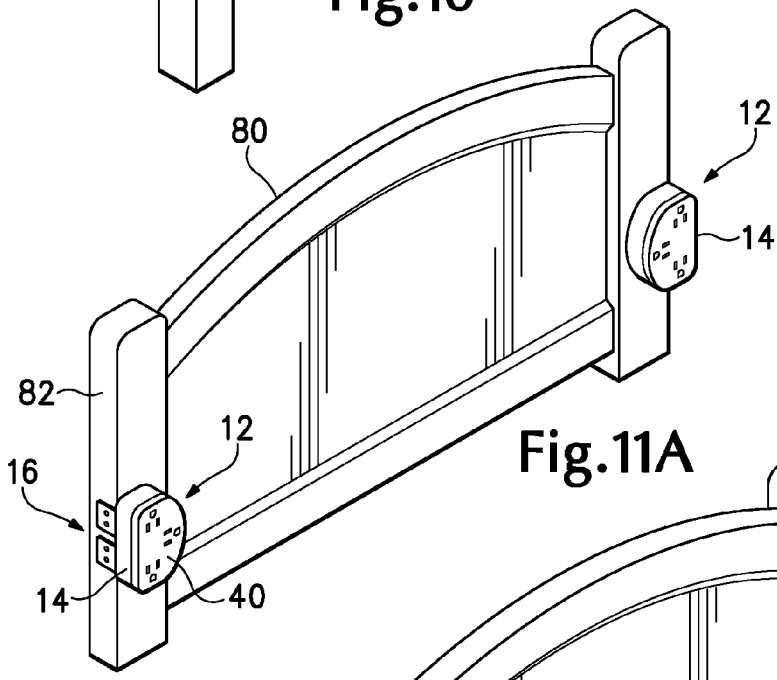
FIGS. 11A and 11B show still other configurations for the electrical outlet assembly in FIG. 1.

FIG. 11A shows another arrangement where two electrical outlet assemblies 12 are attached on opposite sides of a bed headboard 80. The mounting brackets 16 are screwed into sides 82 of the headboard 80. The top surface 40 of the enclosures 14 is substantially parallel with the head board 80.

Figure 11B:
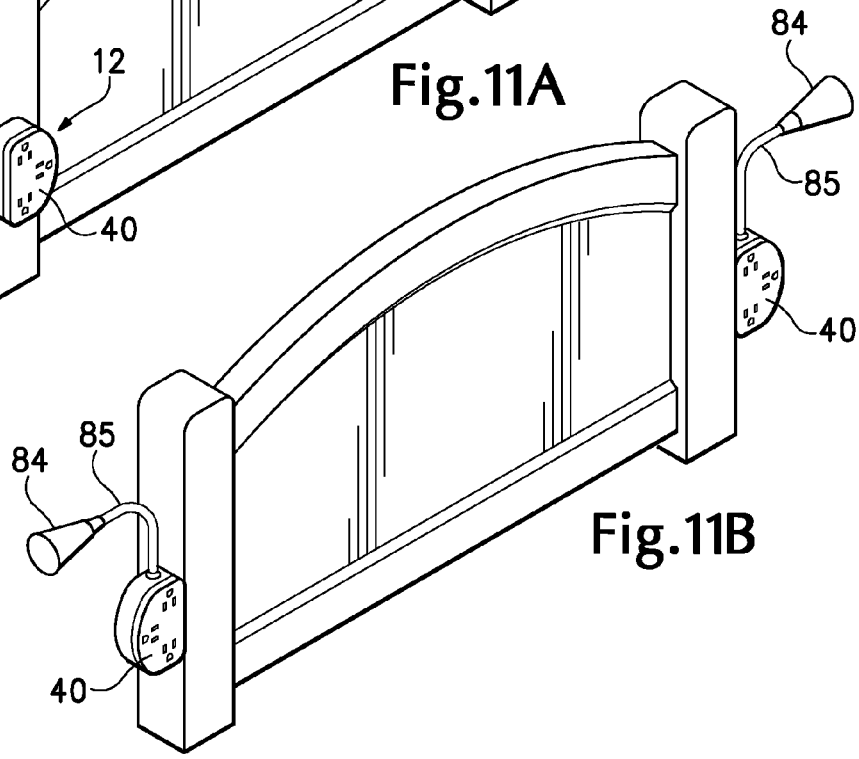

FIG. 11B shows a variation of the outlet assembly shown in FIG. 11A where a light 84 extends out the side of the enclosure 40. In one embodiment the light 84 is connected to the enclosure 40 through a flexible goose neck metal or plastic arm 85. This allows the user to both plug equipment into the enclosure outlets and also provides an additional light source. The switch 30 shown in FIG. 1 may be used to shut off the light 84. Alternatively, there may be two switches 30 on enclosure 40, one controlling power to the outlets 34 and one controlling power from power cord 26 (FIG. 1) to light 84.

Figure 12A:
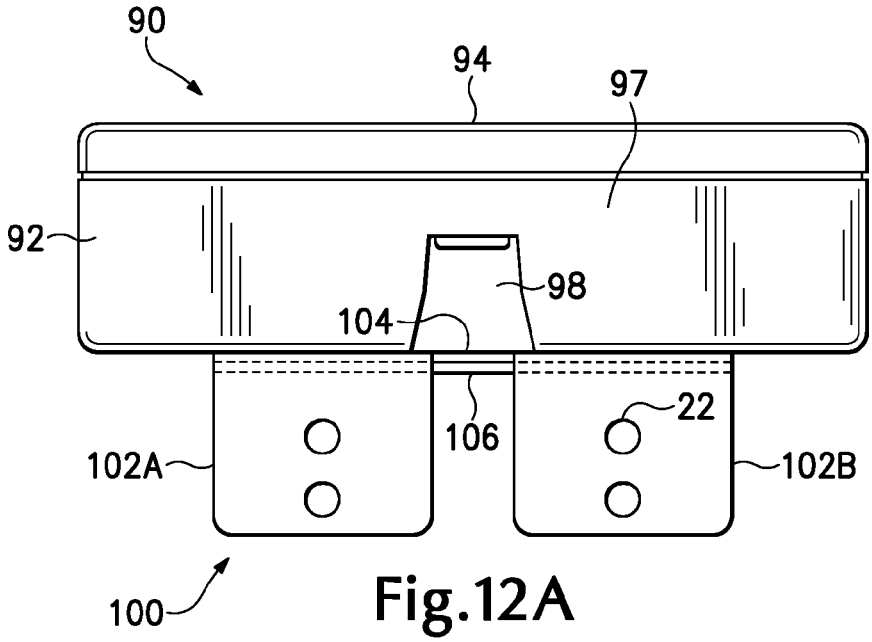
FIGS. 12A-12C show a two plug-in electrical outlet assembly according to another embodiment.
Figure 12B:
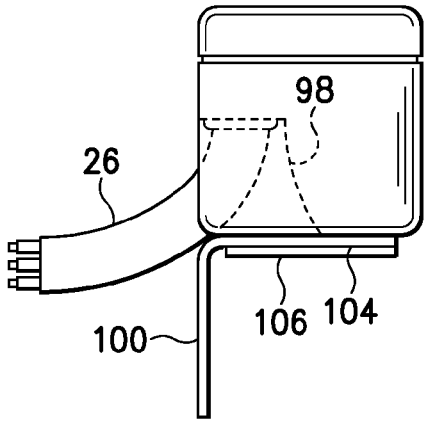
Figure 12C:
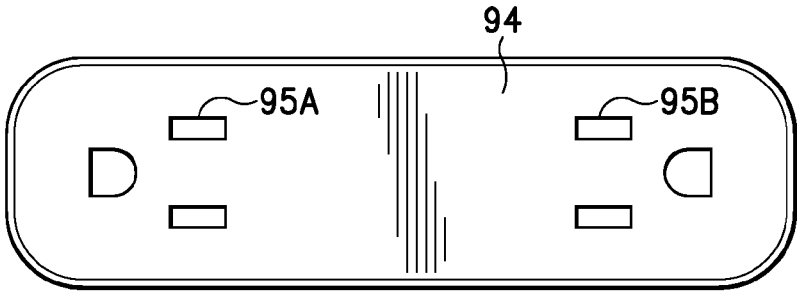

FIGS. 12A-12C show yet another embodiment of a dual power outlet assembly 90. An enclosure 92 includes a top surface 94 that has two outlets 95A and 95B. A back end 97 includes a cavity 98 similar to cavity 24 shown in FIG. 1. The cavity 98 allows the power cord 26 to again be mounted and extend downward from within of the outer perimeter of enclosure 92 and directly underneath top surface 94.

A mounting bracket 100 may be similar to the mounting bracket 16 shown in FIG. 1, however may have a size and shape corresponding with enclosure 92. The mounting bracket 100 includes a support base 104 and mounting arms 102A and 102B that extend down at a 90 degree angle. A rubber pad 106 may be attached to a bottom side of support base 104 and sits in between a mounted piece of furniture and a bottom side of support base 104. In one embodiment, the enclosure is about 4.5 inches long, 1.25 inches wide and 1.25 inches high. Of course, other sizes can also be used according to the number of desired plug-ins 95.

It should be noted that any of the electrical variations described above can be used or not used with any of the power outlet assemblies described above or below. For example, the data port 32 described in FIG. 2 may or may not be used with either assembly 12 in FIG. 1 or assembly 90 in FIG. 12. The switch 30 shown in FIG. 1 and the light 84 in FIG. 11B may not be used for either the assembly 12 in FIG. 1 or assembly 90 shown in FIG. 12.

Wall Mounting

Figure 13A:
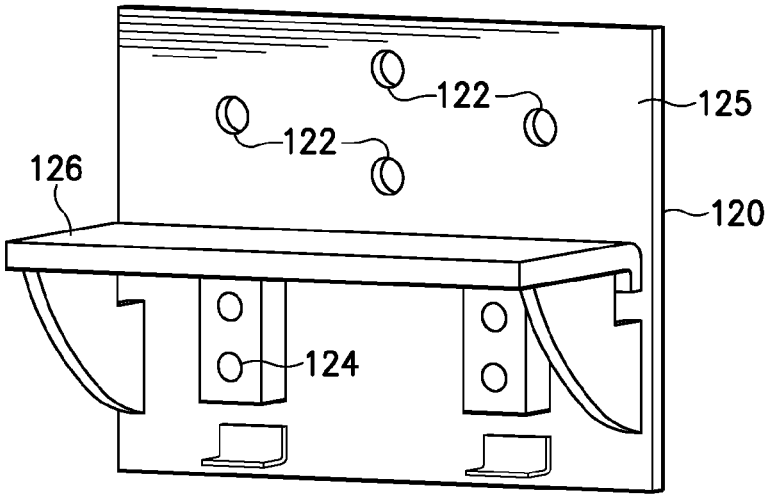
FIGS. 13A-13D show an alternative wall bracket and bracket cover of the electrical outlet assembly.
Figure 13B:
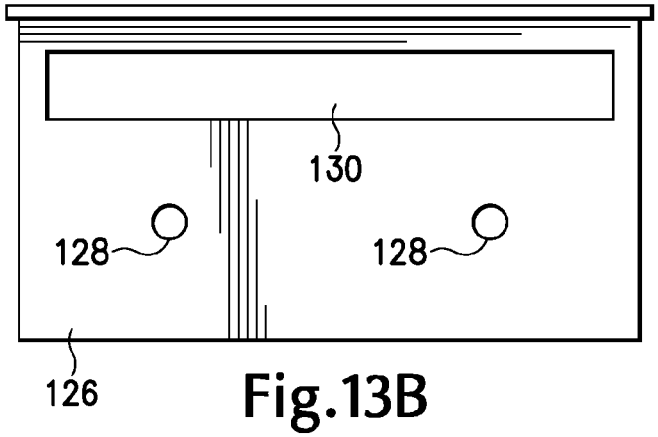
Figure 13C:
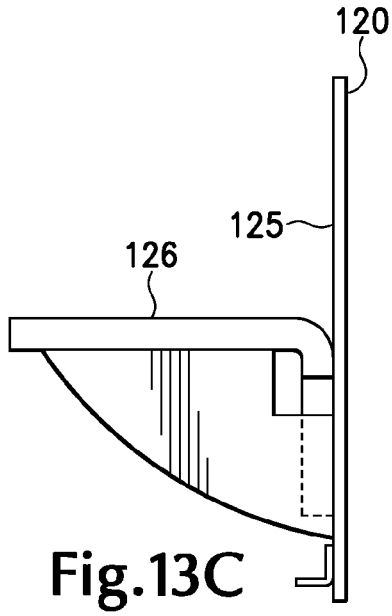
Figure 13D:
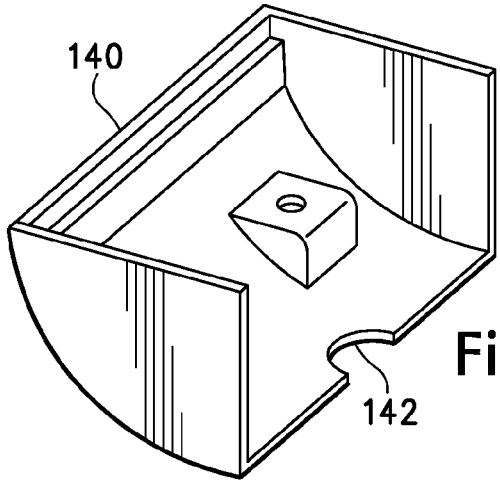

FIGS. 13A-13D show yet another embodiment of a wall bracket 120 used for holding the enclosure 12 in FIG. 1 to the side of a wall. FIG. 13A is a perspective view, FIG. 13B is a top view, FIG. 13C is a side view, and FIG. 13D is a perspective view of a bracket cover. The wall bracket 120 is attached to a wall by inserting screws into holes 122 and 124 of a mounting plate 125. The enclosure 14 in FIG. 1 is then mounted onto a top side of a platform 126 that extends horizontally out from mounting plate 125. The platform 126 includes holes 128 that receive screws that insert into the bottom surface 42 of enclosure 14 (FIG. 1). The platform 126 also includes a slot 130 for threading through the power cord 26. A cover 140 attaches underneath the bottom of platform 126 and includes an opening 142 for receiving the power cord 26.

Surface Mounting

Figure 14A:
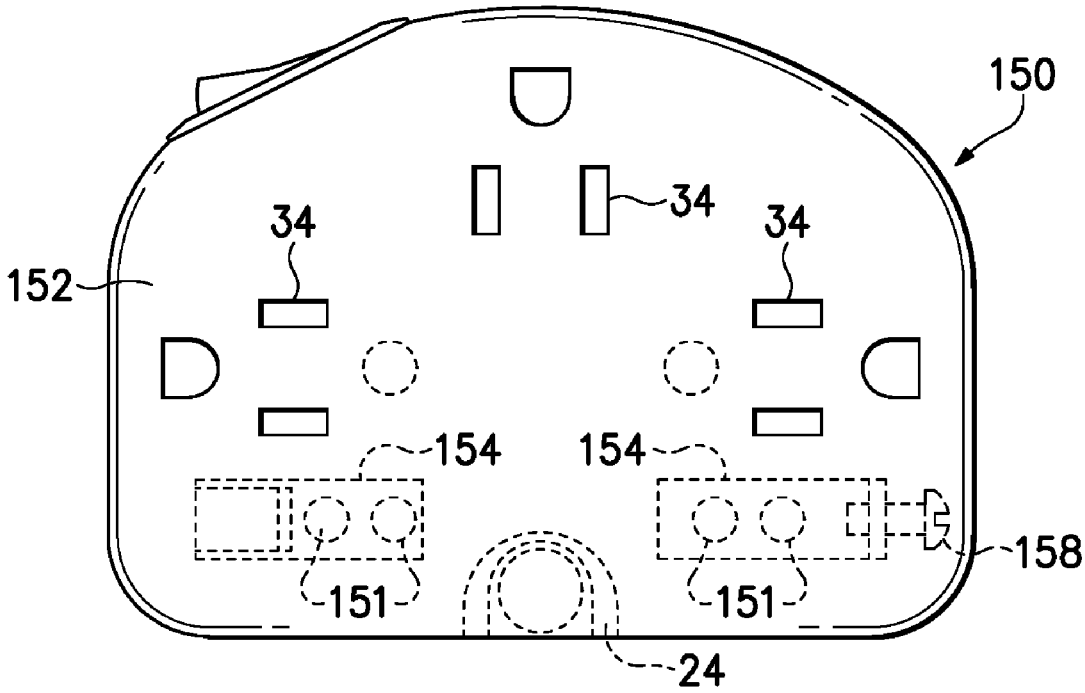
FIG. 14A-14F show a flush mounted outlet assembly.
Figure 14B:
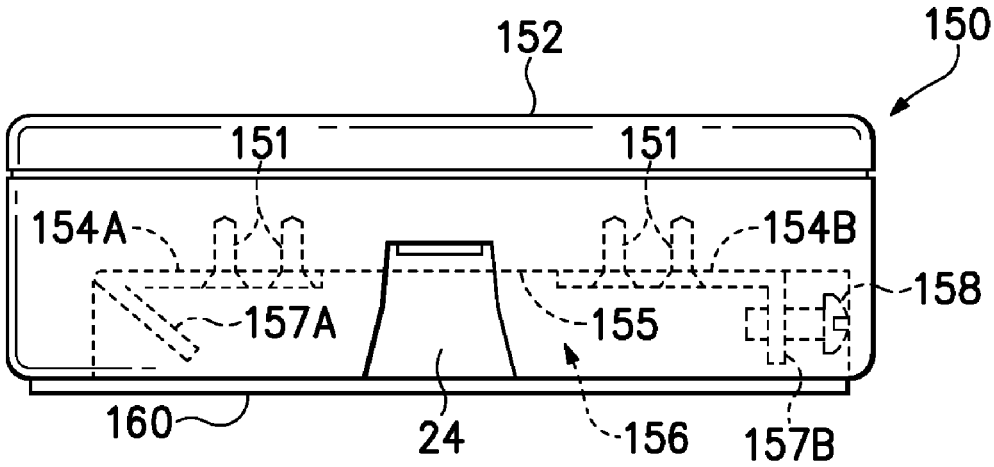
Figure 14C:
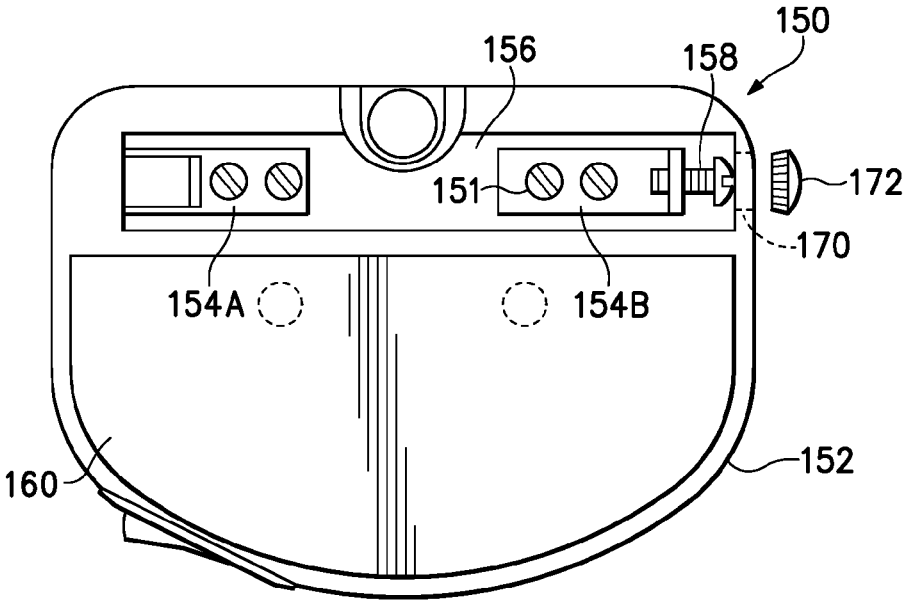
Figure 14D:
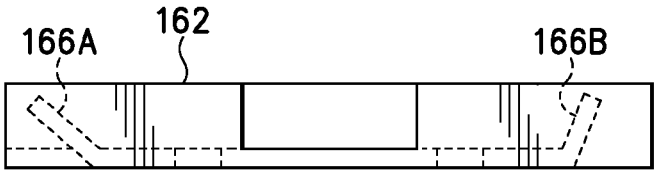
Figure 14E:
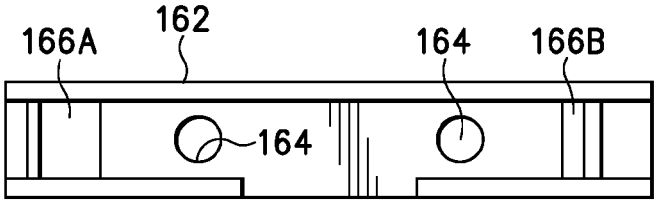
Figure 14F:
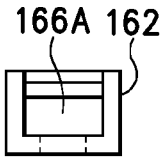

FIGS. 14A-14F show a surface mounted outlet assembly 150. FIG. 14A is a top view of the assembly 150 with phantom lines that show an underneath attachment bracket 154. FIG. 14B is a rear view of the outlet assembly 150 with phantom lines showing the attachment bracket 154 located inside of a compartment 156 formed into the bottom of enclosure 152. FIG. 14C is a bottom view of the outlet assembly 150 showing both the attachment bracket 154 and a rubber pad 160. FIG. 14D is a side view of a mounting bracket 162, FIG. 14E is a top view of the mounting bracket 162, and FIG. 14F is a side view of the mounting bracket 162.

Referring to FIGS. 14A-14F, the flush mounted outlet assembly 150 includes a cavity 24 similar to the cavity shown in FIG. 1. The power cord 26 shown in FIG. 1 can similarly drop substantially straight down from the cavity 24. If the mounting bracket 162 is attached close enough to the edge of a piece of furniture, the power cord 26 would be able to drop substantially straight down over the furniture edge. When the mounting bracket 162 is attached further away from the side of the furniture, the power cord 26 may be required to angle both downward and outward from cavity 24 and then bend down over the edge of the furniture.

The attachment bracket 154 includes a first member 154A and a second member 154B that are attached to the top surface 155 of compartment 156 with screws 151 or some other fastening device such as molded in, adhesive, or other. A mounting bracket 162 includes holes 164 that receive screws for attaching the mounting bracket 162 to furniture or a wall. After the mounting bracket 162 is attached to the furniture or wall, the compartment 156 formed in enclosure 152 is seated down over the mounting bracket 162. A first angled arm 157A on member 154A is hooked underneath a latch arm 166A formed on a first side of mounting bracket 162. A second arm 157B extends down vertically from attachment member 154B and is dropped down over a slightly angled abutment member 166B.

A screw 158 is inserted into an opening 170 formed in enclosure 152 and screwed into a threaded hole formed in arm 157B. The screw 158 is screwed in against abutment member 166B holding the attachment bracket 154 and attached enclosure 152 to mounting bracket 162. As screw 158 extends further against abutment member 166B, the oppositely inclined latch arm 166A and abutment member 166B slightly pull the attachment bracket 154 downward. This in turn seats the enclosure 152 down against a mounting surface such as a table or wall. The rubber pad 160 is pressed downward by the bottom surface of enclosure 152 forming a seal between enclosure 152 and the mounting surface.

The attachment bracket 154 and mounting bracket 162 are completely covered by the compartment 156 formed in enclosure 152 thus increasing the aesthetics of the outlet assembly 150. A plug 172 can be inserted into the hole 170 formed in the side of enclosure 152 for receiving screw 158.

In one embodiment, the attachment bracket 154 and mounting bracket 162 may be made from a metal material. As with any of the other mounting assemblies, the attachment bracket 154 could also be molded from the same niece of material that forms enclosure 152. For example, the enclosure 152 and attachment bracket 154 could be formed from the same piece of plastic.

Having described and illustrated the principles of the invention in a preferred embodiment thereof, it should be apparent that the invention may be modified in arrangement and detail without departing from such principles. We claim all modifications and variation coming within the spirit and scope of the following claims.

The invention claimed is:

1. An electrical outlet device, comprising:

an enclosure having one or more electrical outlets, the enclosure having a top surface, a bottom surface, and a side surface extending from the top surface to the bottom surface and forming an enclosure perimeter; and a cavity extending into the side surface of the enclosure and configured for receiving an electrical power cord that attaches inside of the enclosure perimeter, wherein the cavity includes a top face that extends below the top surface of the enclosure, and wherein the electrical power cord is coupled to the top face of the cavity.

2. The electrical outlet device according to claim 1 wherein the cavity further includes a side face that extends down from the top face through the bottom surface of the enclosure.

3. The electrical outlet device according to claim 1 wherein the electrical power cord drops down between a side face and through an opening in the bottom surface of the enclosure.

4. The electrical outlet device according to claim 1 including three or more electrical plug-ins located on the top surface of the enclosure that each face substantially toward a same location on the top surface of the enclosure.

5. The electrical outlet device according to claim 4 wherein the electrical plug-ins includes:

(i) a first electrical outlet located on a first side of the enclosure, (ii) a second electrical outlet located on a front end of the enclosure and aligned at a 90 degree angle with the first electrical outlet, and (iii) a third electrical outlet located on a second opposite side of the enclosure and aligned at a 90 degree angle with the second electrical outlet and aligned at a 180 degree angle with the first electrical outlet, each electrical outlet having a pair of plug receptacles extending radially about a center location of the top surface of the enclosure.

6. The electrical outlet device according to claim 1 including one or more mounting arms extending down from the bottom surface of the enclosure.

7. The electrical outlet device according to claim 6 wherein the mounting arms include a first mounting arm aligned on a first side of the cavity and a second mounting arm aligned on a second opposite side of the cavity.

8. The electrical outlet device according to claim 7 wherein the power cord extends down through a space between the first and second mounting arm.

9. The electrical outlet device according to claim 6 wherein the one or more mounting arms are either offset from a back end of the enclosure or extend in substantially a same plane with a back end of the enclosure.

10. The electrical outlet device according to claim 6 wherein the one or more mounting arms are either formed from a same piece of material that forms the enclosure and extend down from the bottom surface of the enclosure or the mounting arms are attached to the bottom surface of the enclosure with a support base.

11. The electrical outlet device according to claim 1 including:

a compartment formed in the bottom surface of the enclosure containing an attachment bracket; and a mounting bracket that is contained within the compartment when attached to the attachment bracket so that the bottom surface of the enclosure sits against a piece of furniture or a wall when attached to the mounting bracket.

12. An electrical outlet device, comprising:

an enclosure having one or more electrical outlets, the enclosure having a top surface, a bottom surface, and a side surface extending from the top surface to the bottom surface and forming an enclosure perimeter; and a cavity extending into the side surface of the enclosure and configured for receiving an electrical power cord that attaches inside of the enclosure perimeter, wherein the cavity includes a top face that extends below the top surface of the enclosure and a side face that extends down from the top face through the bottom surface of the enclosure, and wherein the electrical power cord is coupled to the top face of the cavity and then drops down between the side face and through an opening in the bottom surface of the enclosure.

13. An electrical outlet device, comprising:

an enclosure having a top surface, a bottom surface, and a side surface extending from the top surface to the bottom surface and forming an enclosure perimeter, the side surface including a straight back end for abutting a wall;

a cavity extending into the side surface along the straight back end of the enclosure and configured for receiving an electrical power cord that attaches inside of the enclosure perimeter;

a first electrical outlet located on the top surface of the enclosure, the top surface being perpendicular to the straight back end of the side surface;

a second electrical outlet located on the top surface of the enclosure and aligned at a 90 degree angle with the first electrical outlet; and a third electrical outlet located on the top surface of the enclosure and aligned at a 90 degree angle with the second electrical outlet and aligned at a 180 degree angle with the first electrical outlet, each electrical outlet having a pair of plug receptacles extending radially about a center location of the top surface of the enclosure.

14. The electrical outlet device according to claim 13 wherein each electrical outlet includes a ground prong receptacle spaced outward toward the side surface from the pair of plug receptacles.

15. The electrical outlet device according to claim 13 including one or more mounting arms extending down from the bottom surface of the enclosure.

16. The electrical outlet device according to claim 15 wherein the mounting arms include a first mounting arm aligned on a first side of the cavity and a second mounting arm aligned on a second opposite side of the cavity.

17. The electrical outlet device according to claim 16 wherein the power cord extends down through a space between the first and second mounting arm.

18. The electrical outlet device according to claim 15 wherein the one or more mounting arms are substantially parallel to the straight back end of the enclosure.

19. The electrical outlet device according to claim 15 wherein the one or more mounting arms are either formed from a same piece of material that forms the enclosure and extend down from the bottom surface of the enclosure or the mounting arms are attached to the bottom surface of the enclosure with a support base.

* * * * *